US009991679B2

(12) United States Patent
Benz et al.

(10) Patent No.: US 9,991,679 B2
(45) Date of Patent: Jun. 5, 2018

(54) SPARK PLUG INCLUDING A GROUND ELECTRODE HAVING A SMALL CROSS SECTION

(71) Applicant: Robert Bosch GmbH, Stuttgart (DE)

(72) Inventors: Andreas Benz, Bamberg (DE); Manfred Roeckelein, Kemmern (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days. days.

(21) Appl. No.: 15/535,823

(22) PCT Filed: Dec. 3, 2015

(86) PCT No.: PCT/EP2015/078574

§ 371 (c)(1),
(2) Date: Jun. 14, 2017

(87) PCT Pub. No.: WO2016/096464

PCT Pub. Date: Jun. 23, 2016

(65) Prior Publication Data

US 2017/0358903 A1 Dec. 14, 2017

(30) Foreign Application Priority Data

Dec. 16, 2014 (DE) ..... 10 2014 226 096

(51) Int. Cl.
*H01T 13/20* (2006.01)
*H01T 13/16* (2006.01)
(Continued)

(52) U.S. Cl.
CPC ..... *H01T 13/16* (2013.01); *H01T 13/32* (2013.01); *H01T 13/39* (2013.01); *H01T 21/02* (2013.01); *H01T 13/08* (2013.01); *H01T 13/26* (2013.01)

(58) Field of Classification Search
USPC ..... 313/141
See application file for complete search history.

(56) References Cited

U.S. PATENT DOCUMENTS

2001/0025617 A1 10/2001 Kanao
2007/0103046 A1 5/2007 Tinwell
(Continued)

FOREIGN PATENT DOCUMENTS

DE 102004016555 A1 10/2005

OTHER PUBLICATIONS

International Search Report dated Feb. 22, 2016, of the corresponding International Application PCT/EP2015/078574 filed Dec. 3, 2015.

*Primary Examiner* — Vip Patel
(74) *Attorney, Agent, or Firm* — Norton Rose Fulbright US LLP; Gerard Messina

(57) ABSTRACT

A spark plug, including a housing, an insulator situated in the housing, a center electrode situated in the insulator and a ground electrode situated on the housing, the ground electrode and the center electrode being situated relative to one another in such a way that the ground electrode and the center electrode form a spark gap, and the ground electrode including a core and a sheath surrounding the core, the core being made of a material which has a higher thermal conductivity than the material of the sheath, and a cross sectional area of the ground electrode being not greater than 2.76 $mm^2$, the sheath having a wall thickness c of not greater than 0.4 mm in a first region of the ground electrode.

11 Claims, 3 Drawing Sheets

(51) Int. Cl.

| | |
|---|---|
| ***H01T 13/32*** | (2006.01) |
| ***H01T 13/39*** | (2006.01) |
| ***H01T 21/02*** | (2006.01) |
| *H01T 13/26* | (2006.01) |
| *H01T 13/08* | (2006.01) |

(56) References Cited

U.S. PATENT DOCUMENTS

| | | | |
|---|---|---|---|
| 2007/0216275 | A1 | 9/2007 | Torii et al. |
| 2011/0095672 | A1 | 4/2011 | Ban et al. |
| 2014/0239797 | A1 | 8/2014 | Ban |

SPARK PLUG INCLUDING A GROUND ELECTRODE HAVING A SMALL CROSS SECTION

FIELD

The present invention is directed to a spark plug.

BACKGROUND INFORMATION

Due to the increasing reduction of installation space in the engine compartment, there is less space in the engine compartment available for the individual components such as, for example, the spark plug, and the components in the engine compartment must be reduced in size. As a result of this trend of so-called downsizing of the components, new challenges arise in the design of the components and of the spark plug.

The downsizing of the spark plug and its components increases the thermal, electrical and mechanical load on the spark plug and on its individual components. At the same time, the spark plug is intended to exhibit solid reliability and long service life equal to previous spark plugs that were not subject to downsizing.

SUMMARY

Due to the downsizing, the housing must also be modified. The result of this is that the front face of the housing on which the ground electrode is situated becomes narrower. This means that a smaller width of the front face is available for the ground electrode for welding attachment. The dimensions of the ground electrode must be adapted to this reduced space. At the same time, the ground electrode must also withstand the mechanical, thermal, chemical and electrical loads during operation of a spark plug in an internal combustion engine, so that the spark plug exhibits a solid ignition reliability and service life that is comparable to spark plugs which are not subject to downsizing.

An object of the present invention is to provide a spark plug, which is able to meet the requirements mentioned at the outset.

This object may be achieved by the spark plug according to the present invention.

According to the present invention, it is provided that the ground electrode includes a core, which is surrounded by a sheath, the cross sectional area of the ground electrode being not greater than 2.76 $mm^2$, and the ground electrode including a first region, in which the sheath has a wall thickness c of not greater than 0.4 mm. This ensures that the core in this first region of the ground electrode takes up a sufficiently large volume in the ground electrode, so that the ground electrode withstands the thermal loads during the spark plug operation.

The aforementioned limit for the cross sectional area of the ground electrode relates to its largest cross sectional area. The ground electrode may, for example, include multiple regions having different cross sectional areas. The value of the cross sectional area is preferably constant over the entire length of the ground electrode, constant within the context of this application meaning that the value changes by no more than 5%.

Advantageous refinements of the present invention are described herein.

In may be provided, in particular, that the cross sectional area of the ground electrode is not greater than 2.64 $mm^2$ or, particularly preferably, not greater than 2.3 $mm^2$.

The sheath is advantageously made of a more wear-resistant material than the core. The core is made of a material having a higher thermal conductivity than the material of the sheath. The material of the core preferably has a thermal conductivity of at least 350 W/mK at room temperature. In addition or alternatively, it may be provided that the thermal conductivity of the material of the core is at least 300 W/mK greater at room temperature than the thermal conductivity of the material of the sheath. The core is made of copper, silver or an alloy of copper and/or silver, for example. The sheath is made, for example, of a nickel-containing alloy. The Ni-alloy may contain, for example, 20% by weight of chromium, in particular, 25% by weight of chromium. In addition or alternatively, the nickel-containing alloy may also contain yttrium.

It has proven advantageous that the sheath and the core each have a constant cross sectional area in the first region of the ground electrode. The cross sectional area of the core in this case corresponds preferably to at least 20% of the entire cross sectional area of the ground electrode in the first region. The cross sectional area of the ground electrode is the sum of the cross sectional area of the sheath and of the cross sectional area of the core. By maintaining a lower limit for the cross sectional area of the core, it is ensured that the heat dissipation within the ground electrode from one end of the ground electrode facing away from the housing to an end of the ground electrode situated on a spark plug housing is sufficiently great, so that the heat at the end of the ground electrode facing away from the housing absorbed during the operation of the spark plug in an internal combustion engine is dissipated sufficiently rapidly on the housing, which is in thermal contact with a cylinder head, so that the ground electrode exhibits a sufficiently high resistance to the thermal and mechanical as well as chemical loads during operation of the spark plug.

It is preferably provided that the sheath of the ground electrode, in particular, along its entire length, has a wall thickness c of not less than 0.15 mm, so that the core of the ground electrode is sufficiently well protected from the combustion chamber gases occurring during operation of the spark plug.

In addition or alternatively, it may be provided for achieving the aforementioned advantage that the cross sectional area of the core in the first region corresponds to a maximum of 65% of the entire cross sectional area of the ground electrode.

It is preferred that the first region is formed preferably at one end of the ground electrode, which corresponds to an end of the ground electrode situated on the housing of the spark plug. In this way, a good thermal contact is achieved between the ground electrode and the housing.

In one advantageous refinement of the present invention, one end of the ground electrode facing away from the housing has a distance b relative to the core in the ground electrode. Distance b is preferably not greater than 4 mm and, in particular, not smaller than 0.2 mm. When using an ignition surface on the end of the ground electrode facing away from the housing, it is preferred that distance b is in the range of 0.2 mm to 2 mm, so that the highly thermally conductive core is not spaced too far from the ignition surface. The ignition surface typically contains a precious metal or a precious metal alloy and therefore has a higher wear resistance than the sheath material.

If an ignition surface is dispensed with, it has proven advantageous that distance b is at least 2 mm and at most 4 mm. Thus, there is a sufficient volume of sheath material in the region of the ground electrode in which the ignition spark forms so that the ground electrode withstands the thermal and chemical loads during operation of the spark plug for a sufficiently long time. Sufficiently long time means an operation of the spark plugs over at least 50,000 km.

The cross sectional area of the ground electrode may be assigned a height and a width. In this case, the width $x_E$ and the height $y_E$ correspond to two extensions of the cross sectional area, which are perpendicular to one another. Width $x_E$ refers to the longer extension and height $y_E$ refers to a perpendicular extension of the cross sectional area. In a rectangular cross section, width $x_E$ and height $y_E$ of the cross sectional area correspond to the lengths of the sides of the perpendicular cross sectional area. Height $y_E$ of the cross section is preferably not greater than 1.2 mm and, in particular, not smaller than 0.8 mm, in particular, not greater than 1 mm. Width $x_E$ of the cross sectional area of the ground electrode, for example, is not greater than 2.3 mm, in particular, not greater than 2.2 mm or even not greater than 1.9 mm and, in particular, not smaller than 1.6 mm.

Similar to height $y_E$ and width $x_E$ of the cross sectional area of the ground electrode, the core is also assigned a height $y_K$ and a width $x_K$.

The first region is preferably cylindrically shaped. The first region preferably has a length perpendicular to the cross sectional area, which is equal to or is longer than height $y_E$ of the cross sectional area of the ground electrode. The length of the first region is, in particular, at least 1.5 times the length of height $y_E$ of the cross sectional area of the ground electrode.

The cross sectional areas of the core and of the ground electrode preferably have the same shape. As a result, the ground electrode in this first region includes a sheath having a constant thickness.

The ground electrode may be designed as a roof electrode, side electrode or bow electrode.

DETAILED DESCRIPTION OF EXAMPLE EMBODIMENTS

Figure 1:
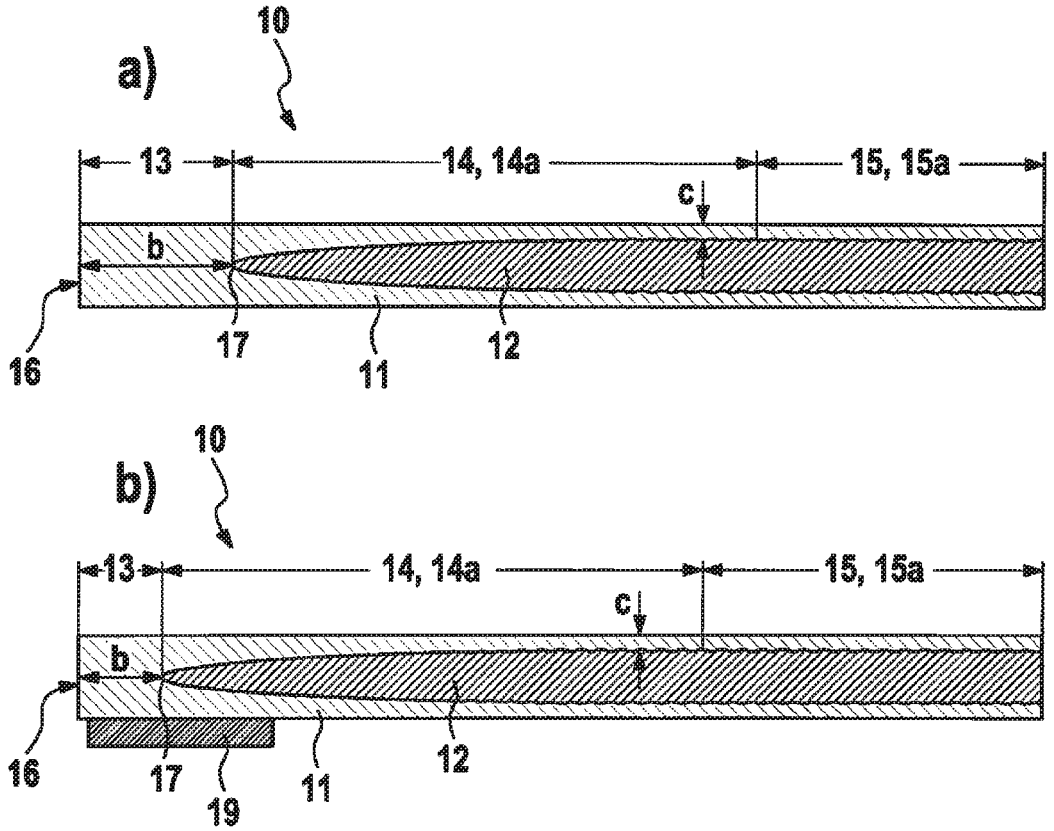
FIG. 1 shows an example of a ground electrode according to the present invention.

FIG. 1 schematically shows depictions for two exemplary specific embodiments of ground electrode 10 according to the present invention. Ground electrode 10 includes a core 12 and a sheath 11 surrounding core 12. Core 12 is made of a material having a higher thermal conductivity than the material of sheath 11. The material of sheath 11 typically has a higher wear resistance than the material of core 12. Core 12 is made of copper, silver or an alloy of copper and/or silver. An Ni-alloy is preferably used as material for sheath 11, whereby chromium and/or yttrium may be contained in the alloy.

Due to the manufacturing method, in this case an extrusion method, core 12 of ground electrode 10 shown here in section includes at least one section 15*a*, in which core 12 has relatively constant dimensions ($x_K$, $y_K$) and associated with that, a relatively constant cross sectional area. The term "relatively constant" within the context of this application means that the dimensions or the cross sectional area values vary by a maximum of 5%.

Dimensions ($x_K$, $y_K$) and the cross sectional area of core 12 are reduced within a second section 14*a*. The at least one first section 15*a* is situated on a side of ground electrode 10 facing away from a combustion chamber, for example, on the side with which the ground electrode is situated on spark plug housing 2. A second section 14*a* of core 12 is connected to the at least one first section 15*a* of core 12 in the direction of the end of ground electrode 10, which protrudes into the combustion chamber when using the ground electrode in a spark plug. In principle, it is conceivable that core 12 includes multiple first sections 15*a* having a constant cross sectional area, dimensions ($x_K$, $y_K$) and the cross sectional area of the individual first sections 15*a* being different. This is the case, in particular, if ground electrode 10 itself includes multiple regions having different dimensions ($x_E$, $y_E$) or cross sectional areas. In the case of multiple first sections 15*a* in core 12, the next closest section to the combustion chamber is second section 14*a* with the continuously tapering cross sectional area of core 12.

Ground electrode 10 depicted in FIG. 1 has constant dimensions ($x_E$, $y_E$) along its length and associated with that, a constant cross sectional area. At least three regions 13, 14, 15 may be distinguished in ground electrode 10. In a first region 15, ground electrode 10 includes a core 12 having a constant cross sectional area and a sheath thickness c of not greater than 0.4 mm. In a second region 14*a*, ground electrode 10 includes a core 12 having a continuously tapering cross sectional area. In a third region 13, ground electrode 10 includes no core.

Thickness c of the sheath of ground electrode 10 results from half the difference of its dimensions ($x_E$, $y_E$) to the core dimensions ($x_K$, $y_K$). If ground electrode 10 in first region 15 has a constant cross sectional area, then sheath thickness c in this first region 15 is constant. It is advantageously provided that in this first region 15, sheath thickness c of ground electrode 10 is not smaller than 0.15 mm and, in particular, not greater than 0.4 mm, for example, sheath thickness c is equal to or smaller than 0.25 mm.

In second region 14, ground electrode may have constant dimensions ($x_E$, $y_E$) and a constant cross sectional area, sheath thickness c in this case increasing within region 14 in the direction of the combustion chamber. Sheath thickness c in second region 14 is at least 0.15 mm thick.

In an alternative specific embodiment not shown here, dimensions ($x_E$, $y_E$) or the cross sectional area of ground electrode 10 may also be reduced in second region 14. Applicable to sheath thickness c in this case is that the sheath thickness is preferably in the range of 0.15 mm to 0.4 mm. It may be provided that dimensions ($x_E$, $y_E$) or the cross sectional area of ground electrode 10 vary at the same rate as dimensions ($x_K$, $y_K$) or the cross sectional area of core 12. This has the advantage that sheath thickness c remains constant in second region 14.

There is no core in third region 13 of ground electrode 10. Third region 13 preferably has constant dimensions ($x_E$, $y_E$) and a constant cross sectional area, which corresponds to dimensions ($x_E$, $y_E$) or the cross sectional area of second region 14 in the transition to third region 13.

Third region 13 of ground electrode 10 has a length b, which extends from an end 17 of core 12 on the combustion chamber side to a front face 16 of ground electrode 10 facing away from the housing. Length b is not greater than 4 mm. If ground electrode 10 is formed with a precious metal-containing ignition surface 19, length b may be designed shorter than ignition surface 19 which does not contain a precious metal, as shown in FIG. 1*b*. Length b is then in the range of 0.2 mm to 2 mm, for example. If a precious metal-containing ignition surface 19 is dispensed with, as shown in FIG. 1*a*, then length b is to have a minimum length of 1 mm, so that sheath 11 includes enough material on the end of ground electrode 10 facing away from the housing to enable a sufficiently long service life of ground electrode 10.

The measure of length b is adjusted to the desired length after the extrusion of ground electrode 10. The excess length of sheath 11 is separated off using a cutting method, a shear method, a stamping method or with the aid of a laser beam. Length b has an influence on the heat dissipation in ground electrode 10. By appropriately selecting length b, it is possible to adjust the heat level of ground electrode 10 on its end 16 facing away from the housing to a desired value, so that end 16 of ground electrode 10 facing away from the housing does not drop below a temperature advantageous for the ignition of the gas mixture in a combustion chamber.

Figure 2:
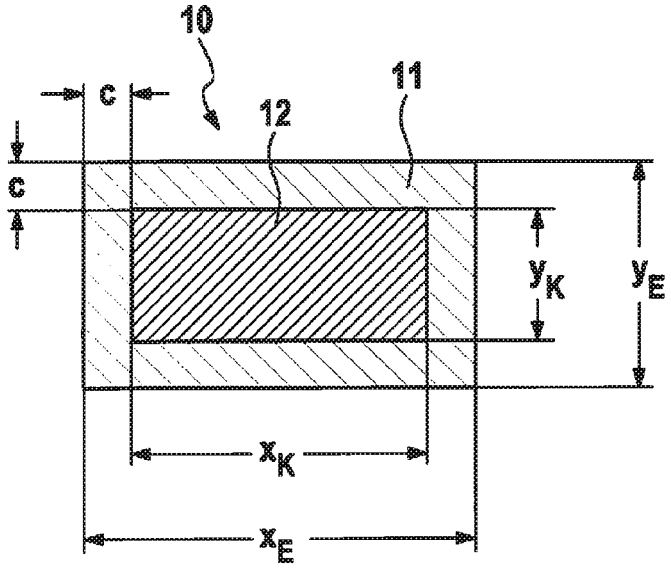
FIG. 2 shows a cross section of the ground electrode according to the present invention.

FIG. 2 shows an example of a cross section of ground electrode 10. In this example, ground electrode 10 and core 13 have a rectangular cross section. The area of the cross section of the ground electrode is not greater than 2.76 $mm^2$. The cross section has a width $x_E$ of not greater than 2.3 mm and a height $y_E$ of not greater than 1.2 mm.

The cross section of core 12 is situated in the center of the cross section of ground electrode 10. Thickness c of sheath 11 results from half the difference of height y and width x of ground electrode 10 ($y_E$, $x_E$) and of core 12 ($y_K$, $x_K$). The cross sections of ground electrode 10 and of core 12 advantageously have the same geometric shape.

The cross sectional area of core 12 is no less than 20% and, in particular, no more than 65% of the cross sectional area of ground electrode 10 in first region 15 of ground electrode 10. The cross sectional area of the ground electrode is composed of the area of sheath 11 and the area of core 12 in cross section.

In one exemplary embodiment not shown herein, it may be provided that the shape of the cross section of ground electrode 10 varies over the course of the length of ground electrode 10. Ground electrode 10 may, for example, have a rectangular cross section at its end 16 facing away from housing 2 and a cross section at its end situated on the housing which is adapted to circular front face 21 of housing 2. This means that height $y_E$ of the cross section of ground electrode 10 corresponds to or is smaller than a width of circular front face 21. Accordingly, width $x_E$ at the end of ground electrode 10 facing housing 2 is then longer than end 16 of ground electrode 10 facing away from the housing. The cross section of ground electrode 10 on its end facing housing 2 has a curvature, i.e., the cross section has a banana-shaped profile, corresponding to the curvature of front face 21 of the housing. The shape of the cross section is modified typically with the aid of stamping, in such case either a rectangular cross section of the end of ground electrode 10 facing the housing may be reshaped by stamping into a banana-shaped profile or end 16 of a ground electrode facing away from the housing having a banana-shaped profile is stamped to form a planar surface.

Figure 3:
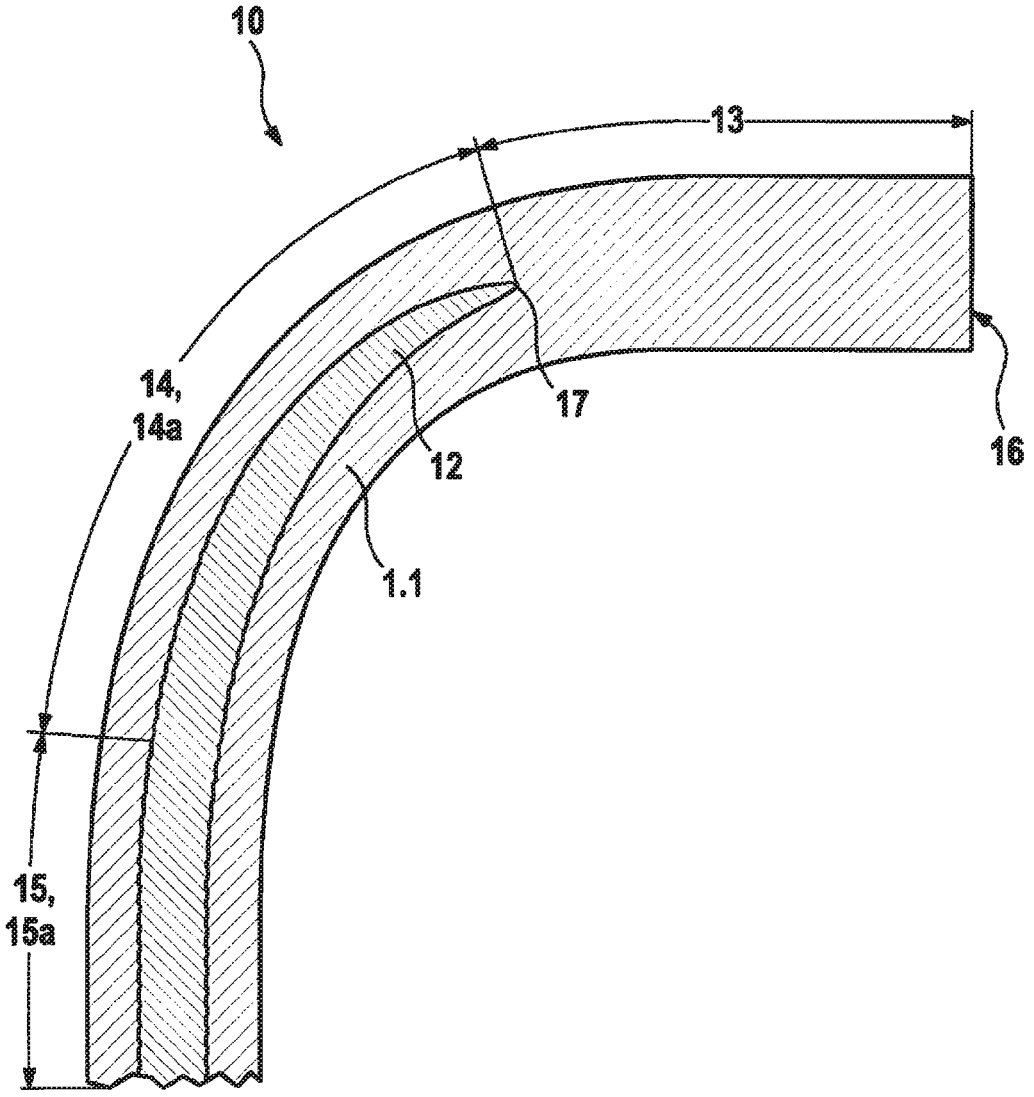
FIG. 3 shows a section of a bent ground electrode according to the present invention.

FIG. 3 shows a section for a ground electrode 10 according to the present invention, which differs from ground electrode 10 shown in FIG. 1 only in that the ground electrode in FIG. 3 is bent. Ground electrode 10 is produced in an initial step by an extrusion method such as, for example, the cup method. Straight ground electrode 10 is welded in a subsequent step to front face 21 of the spark plug housing. Depending on the intended purpose, ground electrode 10 is bent into the desired position in a subsequent step, so that a roof electrode or a side electrode or a bow electrode is formed. In addition, ground electrode 10 may also include an ignition surface 19, which is typically welded to the ground electrode prior to bending.

Even in the case of bent ground electrode 10, it is possible to distinguish the three regions 13, 14, 15 of ground electrode 10 or the two sections 14*a*, 15*a* of core 12. The length of each region is a mean based on the longest and the shortest length of the region, which results along the surface of ground electrode 10.

Figure 4:
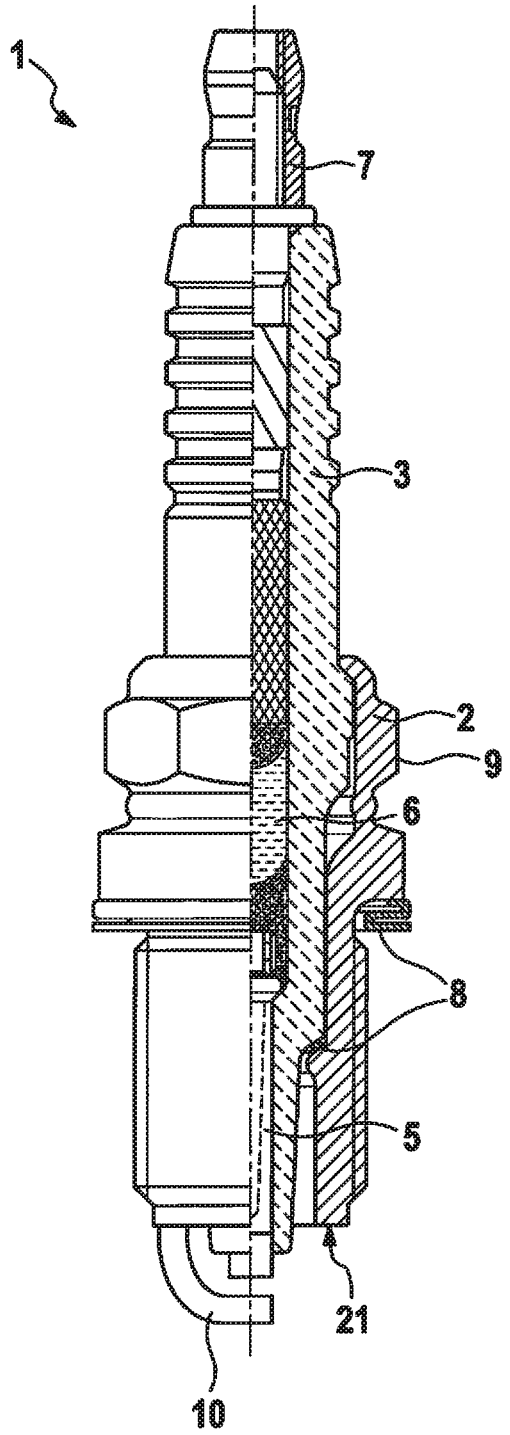
FIG. 4 shows a spark plug including a ground electrode according to the present invention.

FIG. 4 schematically shows a depiction of a spark plug 1 including a ground electrode 10 according to the present invention. Spark plug 1 includes a metal housing 2 having a thread for mounting spark plug 1 in a cylinder head. The thread may have an outer diameter of at least 8 mm, 10 mm or greater. The housing also includes a hexagonal section 9, on which a tool for mounting spark plug 1 in the cylinder head is placed. An insulator 3 is situated inside housing 2. A center electrode 5 and a connection bolt 7 are situated inside insulator 3 and electrically connected via a resistor element 6.

Center electrode 5 projects out of insulator 3 typically at the end of spark plug 1 facing away from the housing. Center electrode 5 is situated with its electrode head 4 on a seat formed on the inner side of insulator 3. Center electrode 5 and/or ground electrode 10 include an attached ignition surface 19. The center electrode may also include a core surrounded by a sheath, the core being made of a material having a higher thermal conductivity than the material of the sheath.

At least one ground electrode 10 according to the present invention is situated at the end of housing 2 facing away from the housing which, together with center electrode 5, forms a spark gap. Ground electrode 10 may be designed as a roof electrode, a side electrode or a bow electrode.

What is claimed is:

1. A spark plug, comprising:

a housing;

an insulator situated in the housing;

a center electrode situated in the insulator; and a ground electrode situated on the housing;

wherein the ground electrode and the center electrode are situated relative to one another so that the ground electrode and the center electrode form a spark gap, and the ground electrode includes a core and a sheath surrounding the core, the core being made of a material which has a higher thermal conductivity than a material of the sheath, wherein a cross sectional area of the ground electrode is not greater than 2.76 $mm^2$, and wherein the sheath has a wall thickness of not greater than 0.4 mm in a first region of the ground electrode.

2. The spark plug as recited in claim 1, wherein the sheath and the core each have a constant cross sectional area along their longitudinal extent in the first region of the ground electrode.

3. The spark plug as recited in claim 1, wherein in the first region, the cross sectional area of the core corresponds to at least 20% of the entire cross sectional area of the ground electrode.

4. The spark plug as recited in claim 1, wherein in the first region, the cross sectional area of the core corresponds to a maximum of 65% of the entire cross sectional area of the ground electrode.

5. The spark plug as recited in claim 1, wherein at an end of the ground electrode facing away from the housing, a distance between the end of the ground electrode and an end of the core is not greater than 4 mm.

6. The spark plug as recited in claim 5, wherein the distance is not smaller than 0.2 mm.

7. The spark plug as recited in claim 1, wherein the cross sectional area of the ground electrode has a height and a width.

8. The spark plug as recited in claim 7, wherein at least one of: (i) the height of the cross sectional area of the ground electrode is not greater than 1.2 mm, and (ii) the width of the cross sectional area of the ground electrode is not greater than 2.3 mm.

9. The spark plug as recited in claim 8, wherein the first region is longer than the height of the cross sectional area of the ground electrode.

10. The spark plug as recited in claim 1, wherein the cross sectional area of the core and the cross sectional area of the ground electrode have the same shape.

11. The spark plug as recited in claim 1, wherein the material of the sheath includes a nickel-containing alloy, the alloy including at least 20% by weight of chromium.

* * * * *